United States Patent [19]

Hall

[11] 3,934,537

[45] Jan. 27, 1976

[54] VIBRATION ISOLATING MOUNT FOR AN OUTBOARD MOTOR

[75] Inventor: Charles B. Hall, Ingleside, Ill.

[73] Assignee: Outboard Marine Corporation, Waukegan, Ill.

[22] Filed: Nov. 18, 1974

[21] Appl. No.: 524,790

[52] U.S. Cl. ..... 115/17; 188/1 B; 403/220; 403/225; 248/4

[51] Int. Cl.[2] ..... B63H 21/26

[58] Field of Search ..... 115/17, 18 R, 18 E, 18 A; 248/4, 15; 123/198 E; 188/1 B; 16/2; 403/220, 224–226, 228

[56] References Cited

UNITED STATES PATENTS

| | | | |
|---|---|---|---|
| 2,740,368 | 4/1956 | Irgens et al. | 115/18 |
| 2,916,007 | 12/1959 | Kiekhaefer | 115/18 R |
| 3,599,594 | 8/1971 | Taipale | 115/17 |

*Primary Examiner*—Trygve M. Blix
*Assistant Examiner*—Sherman D. Basinger
*Attorney, Agent, or Firm*—Michael, Best & Friedrich

[57] ABSTRACT

Disclosed herein is vibration isolating arrangement for an outboard motor having a propulsion unit mounted rearwardly of the steering axis of the outboard motor and including a powerhead, a drive shaft housing having a drive shaft, and a lower unit carrying a propeller. The mounting arrangement includes an upper mount and a pair of lower mounts secured to the propulsion unit in vertically spaced relation and rearwardly of or behind the drive shaft. The top mount includes a cross bar which has a wedged-shaped cross section with the upper and lower surfaces thereof converging in the direction of propeller thrust, which is supported by a resilient bushing within a casing, and which has outer ends extending from the casing transversely to the direction of propeller thrust for connection to a swivel bracket. The lower mounts are mounted in laterally spaced recesses provided in the drive shaft housing. Each of the lower mounting units includes an insert which has a wedge-shaped cross section with the upper and lower surfaces thereof diverging in the direction of forward propeller thrust and which is supported by a pair of resilient pads disposed between a pair of spacer members which fit snugly into opposed grooves provided in each drive shaft housing recess.

22 Claims, 9 Drawing Figures

VIBRATION ISOLATING MOUNT FOR AN OUTBOARD MOTOR

BACKGROUND OF THE INVENTION

The isolation of a boat hull from vibration emanating from a propulsion unit of an outboard motor has conventionally been accomplished by a plurality of mounts. Exemplary prior art constructions for such mounts are disclosed in the following United States patents:

Irgens et al U.S. Pat. No. 2,740,368, issued Apr. 3, 1956

Kiekhaefer U.S. Pat. No. 2,911,936, issued Nov. 10, 1959

Kiekhaefer U.S. Pat. No. 2,916,007, issued Dec. 8, 1959.

Watkins U.S. Pat. No. 3,002,489, issued Oct. 3, 1961.

Mohr U.S. Pat. No. 3,127,866, issued Apr. 7, 1964.

Post U.S. Pat. No. et al 3,358,668, issued Dec. 19, 1967.

Taipale U.S. Pat. No. 3,599,594, issued Aug. 17, 1971.

Haft U.S. Pat. No. et al 3,750,615, issued Aug. 7, 1973.

SUMMARY OF THE INVENTION

The invention provides a vibration mounting arrangement including upper and lower mounts for connecting a propulsion unit of an outboard motor to a swivel bracket.

In accordance with the invention, the upper mount includes a cross bar which is disposed transversely to the direction of propeller thrust and in connected to one of the propulsion unit and the swivel bracket. The cross bar includes a portion which has a wedge-shaped cross section with upper and lower surfaces converging in the direction of forward propeller thrust and is encircled by a resilient bushing which is connected to the other of the propulsion unit and the swivel bracket.

Also in accordance with the invention, the lower mount includes at least one mounting unit disposed in a recess provided in the lower portion of the drive shaft housing. The lower mounting unit includes an insert connected to the swivel bracket and having a wedge shape with the upper and lower surfaces thereof diverging in the direction of forward propeller thrust and a resilient pad disposed between each of the insert surfaces and the walls of opposed grooves provided in each drive shaft housing recess.

A primary feature of the invention is the provision of a vibration isolating mounting arrangement for an outboard motor, which arrangement is capable of providing increased load capacity in the forward direction and low rates of shear in both the fore and aft and lateral modes.

Another primary feature of the invention is the provision of a mounting device for mounting and vibrationally isolating vibrating equipment from a support.

Other features, aspects and advantages of the invention will become apparent upon reviewing the following detailed description, the drawings and the appended claims.

Figure 1:
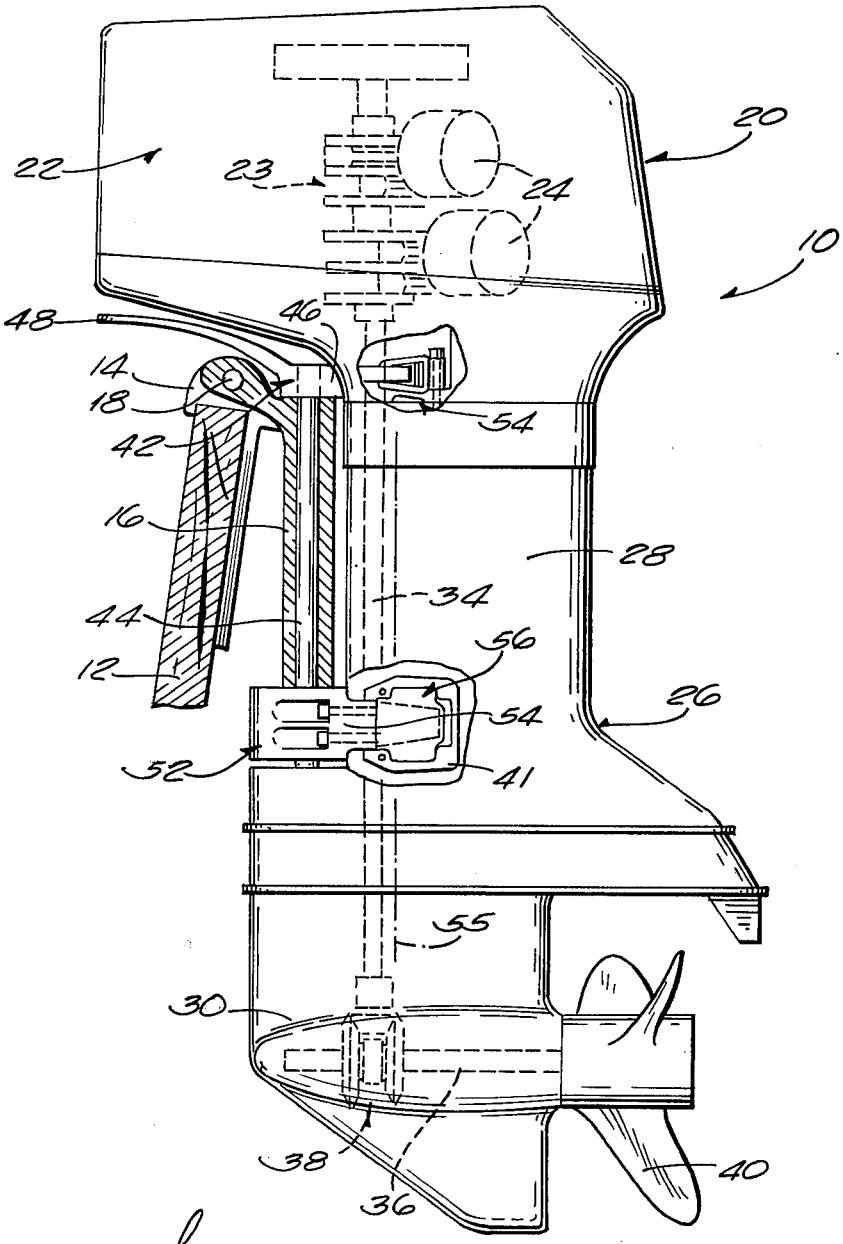
FIG. 1 is a side elevational view of an outboard motor with portions broken away to show the vibration mounting arrangement.
Figure 2:
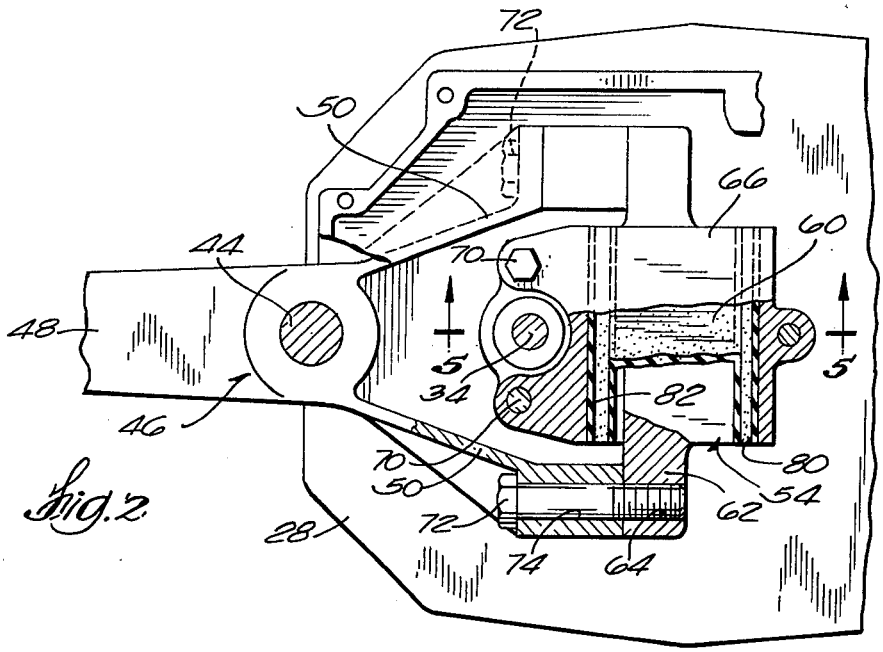
FIG. 2 is a fragmentary top view of a portion of the outboard motor partially broken away to show the upper mount.
Figure 3:
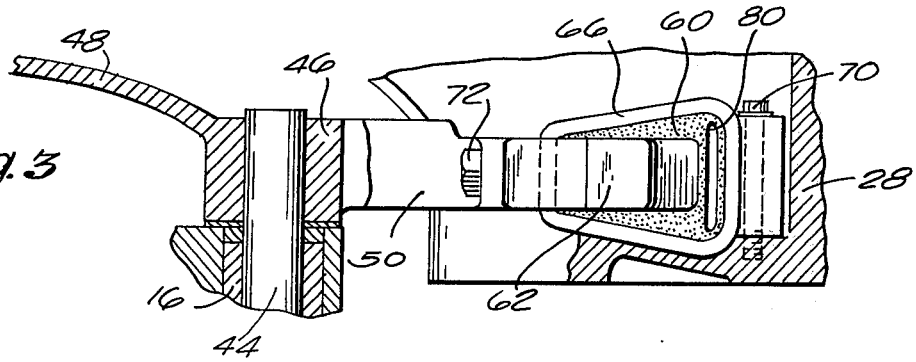
FIG. 3 is a side view, in section, of the upper mount in the propulsion unit.
Figure 4:
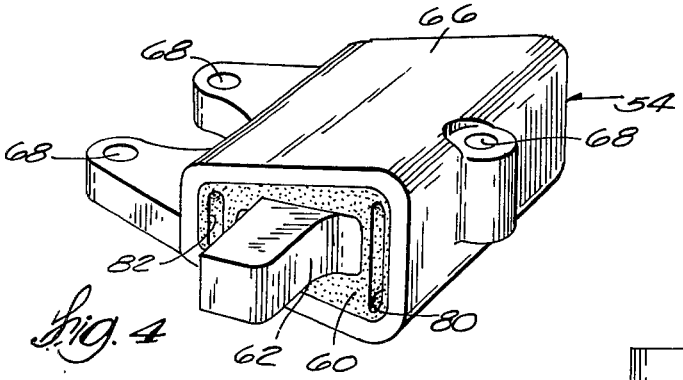
FIG. 4 is a perspective view of the upper mount.
Figure 5:
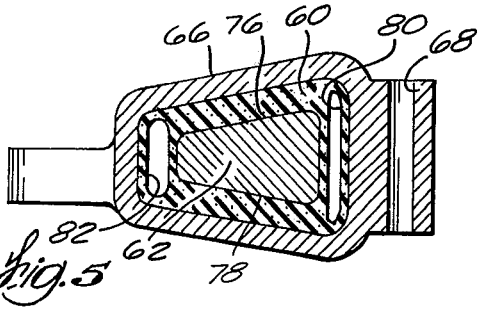
FIG. 5 is a sectional view taken along line 5—5 in FIG. 2.

Before explaning the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Illustrated in the drawings is an outboard motor 10 shown mounted on the transom 12 of a boat hull. The outboard motor 10 conventionally includes a clamp or transom bracket 14 and a steering or swivel bracket 16 secured to the transom bracket 14 for vertical tilting movement by means of a pivot pin 18. Mounted on the swivel bracket 16 is a propulsion unit 20 including a power head 22 which has an engine 23 with a cylinder block and pistons 24 and which is carried on a lower unit 26 having a drive shaft housing 28 rigidly supporting the power head 22 and a gear case 30 rigidly attached to the bottom of the drive shaft housing 28. Rotatably supported inside the drive shaft housing 28 is a vertically disposed drive shaft 34 which is drivingly connected to the engine 23 and also drivingly connected to the propeller shaft 36 through a reversing transmission 38 to drive a propeller 40 carried on the aft and of the propeller shaft 36. The drive shaft housing 28 includes a pair of mounting openings or recesses (generally designated at 41) located some distance above the gear case 30.

Engines of various types can be employed. However, the disclosed vibration isolating arrangement is most effective with V-type engines which do not produce a rocking couple such as produced by an oppositely acting, two cylinder, internal combustion engine.

The propulsion unit 20 is mounted for pivotal steering movement on the swivel bracket 16 by means of a king pin assembly 42 which includes a pivot shaft 44 journalled in the swivel bracket 16. Secured to the upper end of the pivot shaft 44 is an upper yoke 46 having a forwardly extending steering bracket 48 and rearwardly extending arms 50. Secured to the lower end of the pivot shaft 44 is a lower yoke 52 having rearwardly extending arms 53.

The propulsion unit 20 is subject to various vibrations including torsional or oscillatory vibration set up by the power impulses of the engine. These torsional vibrations occur about a roll or neutral axis which is generally indicated at 55 and which extends approximately vertically through the center of mass of the propulsion unit 20 and is generally spaced from the drive shaft 34 on the same side as the pistons 24. Forward and reverse thrust forces are also set up in the propulsion unit 20 by the motion of the propeller 40.

In accordance with the invention, the vibrations generated in the propulsion unit 20 are isolated from the boat hull by an upper resilient mount 54 and a lower resilient mount designated at 56. The upper and lower mounts 54 and 56 are vertically spaced, are connected between the propulsion unit 20 and the king pin assembly 42, and are located generally rearwardly of the drive shaft 34. The upper mount 54 and the lower mount 56 provide the principal support for the weight of the propulsion unit 20 and transmit the thrust force of the propeller to the boat hull. When a forward thrust is produced by the propeller 40, the principal force acting on the upper mount 54 occurs on the forward side thereof and the principal force acting on the lower mount 56 occurs on the aft side thereof.

More particularly, referring to FIG. 2 through 5, the upper mount 54 includes a wedge-shaped bushing 60 formed from a resilient material such as natural rubber and an elongated, rigid insert or cross bar 62 having a threaded mounting hole 64 on each end. The cross bar 62 is encircled or imbedded in the bushing 60 and extends outwardly from each end of the bushing 60. The bushing 60 is enclosed in a wedge-shaped casing 66 which is secured to the outer surface of the bushing 60 and has mounting holes 68 for connecting the upper mount 54 to the propulsion unit 20 such as by bolts 70 extending through the mounting holes 68 and threaded into the drive shaft housing 28. The bushing 60 can be molded in situ and integrally bonded to the cross arm 62 and the casing 66 or formed as a separate part and suitably bonded to the cross arm 62 and to the casing 66. The upper mount 54 is connected to the upper yoke 46 by studs 72 extending through mounting holes 74 provided on the ends of the upper yoke arms 50 and threaded into the mounting holes 64 on the cross bar 62.

In order to provide low rates of shear in both the fore and aft and the lateral modes, the portion of the cross bar 62 encircled by the bushing 60 has a generally wedge-shaped cross section with the upper and lower outer surfaces 76 and 78 thereof diverging rearwardly, (i.e., converging in the direction of forward propeller thrust). Such an arrangement also provides an increased load capacity in the forward direction for handling the principal thrust force on the upper mount 54 occurring on the forward side of the bushing 60.

To more effectively damp vibrations emanating from the propulsion unit 20, it is desirable that the bushing 60 be softer in the lateral direction than in the forward direction. This is accomplished in part by means of open-ended, elongated slots 80 and 82 provided in the bushing 60 on the opposite sides of the cross arm 62. The slots 80 and 82 extend through the entire length of the bushing 60 in generally parallel spaced relation to the cross arm 62. The slots 80 and 82 accomodate fore and aft movement of the cross bar 62 relative to the casing 66 thereby insuring that the bushing 60 is principally or substantially entirely in shear under normal operating conditions.

Referring to FIGS. 6 through 9, the lower mount 56 includes a pair of transversely spaced, resilient mounting units 84, each including a rigid insert 86 having threaded mounting holes 88 on the front face 90, a pair of cushion or pads 92 formed from a resilient material such as natural rubber and secured to the upper and lower outer surfaces 94 and 96 of the insert, and a pin 98 having opposite end portions 100 which extend outwardly from the outer sides of the insert 86 and beyond the outer edges of the pads 92. The outer surfaces of the insert 86 (except for the front face 90) and the pin 98 are covered or encased with a resilient shield or coating 102. Secured to the outer surfaces of the pads 92 are a pair of rigid spacer members 104 having inner surfaces 105 which are located in spaced, parallel relation to the upper and lower surfaces 94 and 96 of the insert 86. The spacer members 104 preferably are covered or encased by a resilient shield or coating 106.

The resilient coatings 102 and 106 and pads 92 preferably are molded in situ as an integral part of the mounting unit 84, in which case the coatings 102 and 106 are continuous. However, if desired, the pads 92 can be formed separately and suitably bonded to the insert 86 and to the spacer members 104, and the coatings 102 and 106 thereafter molded integrally over the insert 86, the pin 98 and the spacer members 104 or molded as separate parts and suitably bonded to the outer surfaces of the insert 86, the pin 98 and the spacer members 104.

Each of the lower mounting units 84 is connected to the lower portion of the drive shaft housing 28 by being positioned in respective openings or recesses 41 which are located on the opposite sides of the drive shaft housing 28 and generally rearwardly of the drive shaft axis. The spacer members 104 of the mounting unit 84 are received within respective vertically spaced grooves 108 provided in each recess 41 with the resilient coating 106 fitting snugly against the walls of the grooves 108 (See FIG. 7 and 8).

A cap plate 110 overlying each recess 41 is secured to the drive shaft housing 28 such as by screws (not shown) and together with the recess 41 forms a cavity in which a lower mounting unit 84 is disposed. When installed, the cover plate 110 engages portions of the coating 106 covering the outer edges of the spacer members 104 and cooperates with the walls 114 of the grooves 108 to limit transverse movement of the mounting unit 84 relative to the drive shaft housing 28. (See FIGS. 6 and 8). Each mounting unit 84 is connected to a respective arm 53 of the lower yoke 52 by bolts 115 which extend through the mounting holes 116 provided on the ends of the lower yoke arms 84 and which are threaded into the mounting holes 88 on the insert 86.

In order to provide low rates of shear in both aft and fore and lateral modes, the insert 86 has a wedge-shaped cross section with the upper and lower surfaces 94 and 96 diverging forwardly, (i.e., diverging in the direction of forward propeller thrust). Similarly, the inner surfaces 105 of the spacer members 104 diverge forwardly and generally in parallel spaced relation to the upper and lower surfaces 94 and 96 of the insert 86 (See FIG. 7). Provided in each drive shaft housing recess 41 and in each cover plate 110 are opposed notches 120 and 122 (see FIGS. 6 and 8) which receive the respective outer end portions 100 of the pin 98 and are dimensioned to limit fore and aft movement of the pin, and thus the insert 86, relative to the spacer members 104 so as to prevent structural failure of the pads 92.

It is desirable that the mounting units 84 be softer in the lateral direction than in the fore and aft directions in order to more effectively damp vibrations emanating from the propulsion unit 20. This is accomplished by arranging the mounting units 84 so that they are principally or substantially entirely in shear during normal operations. The notches 120 and 122 are dimensioned to accommodate some transverse or lateral movement of the pin 98, and thus the insert 86, relative to the drive shaft housing 28, and, in addition, the drive shaft housing recess 41 is provided with an offset portion 124 at the aft end (See FIG. 7) for accommodating some rearward or aft movement of the insert 86 relative to the drive shaft housing 28. Also, the transfer of mechanical vibrations from the drive shaft housing 28 to the lower mounting units 84 is minimized because the only possible mechanical contact therebetween is through the resilient coatings 102 and 106.

Figure 6:
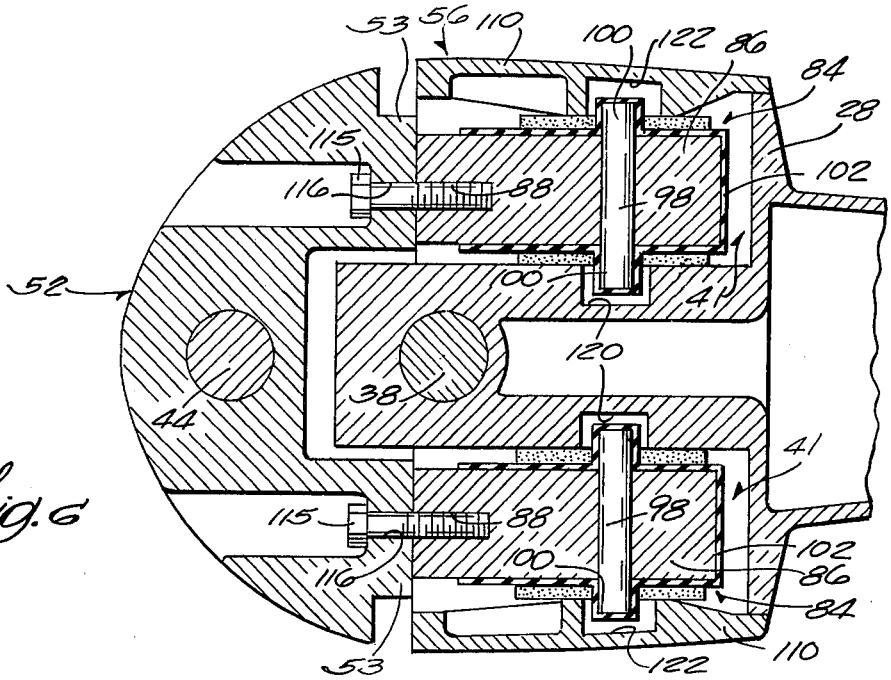
FIG. 6 is a top view, in section, of the lower mount positioned within the drive shaft housing of the propulsion unit.
Figure 7:
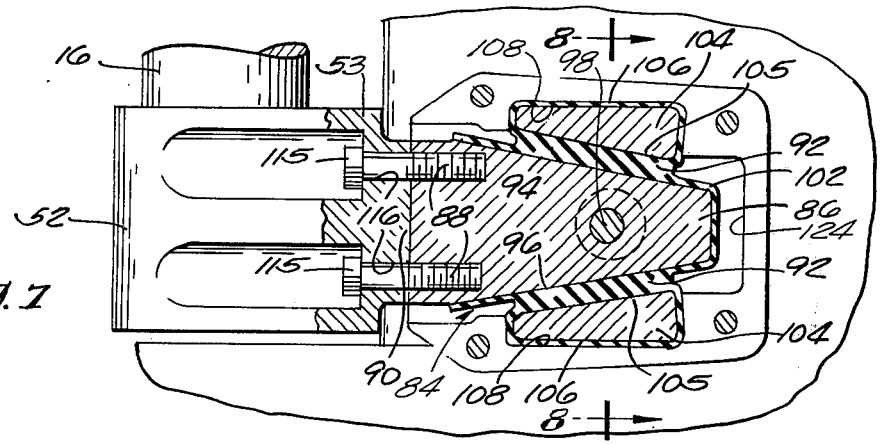
FIG. 7 is a side view, in section, of a lower mount unit.
Figure 8:
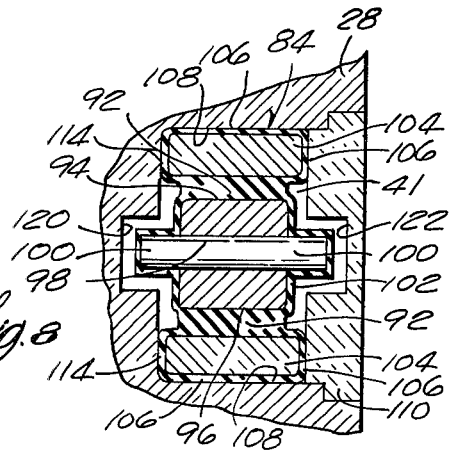
FIG. 8 is a sectional view taken along the line 8—8 in FIG. 7.
Figure 9:
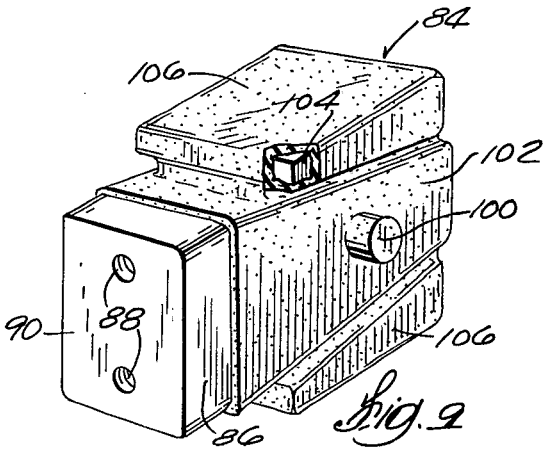
FIG. 9 is a perspective view of a lower mount unit.

If desired, the lower mounting units 84 can be rotated 90° from the position illustrated in FIGS. 6 through 8.

Various of the features of the invention are set forth in the following claims.

I claim:

1. An outboard motor comprising a transom bracket, a swivel bracket mounted on said transom bracket for vertical tilting movement, a propulsion unit including a drive shaft housing having a lower portion and a rotatably mounted propeller shaft carrying a propeller, means for mounting said propulsion unit from said swivel bracket including a lower mount including an insert connected to said swivel bracket and having a wedge-shaped cross section with upper and lower outer surfaces diverging in the direction of forward propeller thrust, and a resilient pad disposed between each of said insert surfaces and said propulsion unit.

2. An outboard motor comprising a transom bracket, a swivel bracket mounted on said transom bracket for vertical tilting movement, a propulsion unit including a rotatably mounted propeller shaft carrying a propeller, means for mounting said propulsion unit from said swivel bracket including an upper mount having a cross bar which is disposed transversely to the direction of the propeller thrust, which is connected to one of said swivel bracket and said propulsion unit, and which includes a portion having a wedge-shaped cross section with upper and lower surfaces converging in the direction of forward propeller thrust, and a resilient member which engages said upper and lower surfaces and is connected to the other of said swivel bracket and said propulsion unit.

3. An outboard motor comprising a transom bracket, a swivel bracket mounted on said transom bracket for vertical tilting movement, a propulsion unit including a rotatably mounted propeller shaft carrying a propeller, means for mounting said propulsion unit from said swivel bracket including an upper mount having a cross bar which is disposed transversely to the direction of the propeller thrust, which is connected to one of said swivel bracket and said propulsion unit, and which includes a portion having a wedge-shaped cross section with upper and lower surfaces converging in the direction of forward propeller thrust, and a resilient bushing which encircles said cross bar portion and is connected to the other of said swivel bracket and said propulsion unit.

4. An outboard motor according to claim 3 wherein said cross bar is connected to said swivel bracket and said bushing is connected to said propulsion unit.

5. An outboard motor according to claim 4 including a casing enclosing said bushing and connected to said propulsion unit.

6. An outboard motor according to claim 3 including a vertically disposed drive shaft and wherein said cross bar is disposed rearwardly of said drive shaft.

7. An outboard motor according to claim 3 wherein said bushing includes an elongated slot disposed on each of the opposite sides of said cross bar and extending through the entire length of said bushing in generally parallel spaced relation to said cross bar.

8. An outboard motor comprising a transom bracket, a swivel bracket mounted on said transom bracket for vertical tilting movement, a propulsion unit including a drive shaft housing having a lower portion and a rotatably mounted propeller shaft carrying a propeller, means for mounting said propulsion unit from said swivel bracket, said mounting means including a recess located in said lower portion of said drive shaft housing and having opposed grooves, a a lower mount connected to said swivel bracket and disposed in said recess grooves, said lower mount including an insert connected to said swivel bracket and having a wedge-shaped cross section with upper and lower outer surfaces diverging in the direction of forward propeller thrust, and a resilient pad disposed between each of said insert surfaces and said recess grooves.

9. An outboard motor according to claim 8 wherein said lower mount includes a pair of spacer members respectively located in said grooves and having respective inner surfaces located in parallel spaced relation to said insert surfaces, and said pads are disposed between and bonded to said spacer members inner surfaces and said insert surfaces.

10. An outboard motor according to claim 9 including means associated with said lower mount for limiting fore and aft movement of said insert relative to said spacer members.

11. An outboard motor according to claim 10 wherein said motion limiting means comprises a plate member overlying said recess and mounted on said drive shaft housing, pin means extending outwardly from each of the opposite sides of said insert, and a pair of opposed notches in said drive shaft housing recess and said plate member for receiving respective outer end portions of said pin means and permitting limited fore and aft movement of said insert relative to said spacer members.

12. An outboard motor according to claim 11 including means for preventing transmission of mechanical vibrations from said drive shaft housing to said swivel bracket.

13. An outboard motor according to claim 12 wherein said insert includes a face adjacent said swivel bracket and said last mentioned means comprises a coating of resilient material covering the outer surfaces of said pin means, said spacer members, and said insert, except for said face.

14. An outboard motor comprising a transom bracket, a swivel bracket mounted on said transom bracket for vertical tilting movement, a propulsion unit which includes a drive shaft housing having a vertically disposed drive shaft, a lower portion, and a rotatably mounted propeller shaft carrying a propeller, means for pivotally mounting said propulsion unit on said swivel bracket for steering movement rearwardly of said swivel bracket and including an upper yoke and a lower yoke, an upper mount having a cross bar which is disposed transversely to the direction of the propeller thrust, which is connected to said upper yoke, and which includes a portion having a wedge-shaped cross section with upper and lower surfaces converging in the direction of forward propeller thrust, a resilient bushing encircling said cross bar portion and connected to said propulsion unit, a pair of laterally spaced recesses located in said drive shaft housing lower portion, each of said recesses having vertically opposed grooves, a pair of lower mounts connected to said lower yoke and disposed in respective of said recesses, each of said lower mounts including an insert connected to said lower yoke and having a wedge-shaped cross section with upper and lower surfaces diverging in the direction of forward propeller thrust, and a resilient pad disposed between each of said insert surfaces and respective of the walls of said recess grooves.

15. An outboard motor according to claim 14 including a casing enclosing said bushing and connected to said propulsion unit, and wherein said bushing includes an elongated slot disposed on each of the opposite sides of said cross bar and extending through the entire length of said bushing in generally parallel spaced relation to said cross bar.

16. An outboard motor according to claim 15 wherein each of said lower mounts includes a pair of spacer members respectively located in said grooves and having respective inner surfaces located in parallel spaced relation to said insert surfaces, said pads are disposed between and bonded to said spacer members inner surfaces and said insert surfaces, and said outboard motor further includes a plate member overlying each of said recesses and mounted on said drive shaft housing, pin means extending laterally outwardly from each of the opposite sides of each of said inserts, and a pair of opposed notches in each of said drive shaft housing recesses and said plate members for receiving respective outer end portions of said pin means and permitting limited fore and aft movement of said insert relative to said spacer members.

17. A device for mounting and vibrationally isolating vibrating equipment from a support comprising a wedge-shaped member adapted to be connected to said support and having opposed outer surfaces which converge in a direction away from said support, a pair of spacers having inner surfaces located in parallel spaced relation to respective of said member surfaces, a resilient pad disposed between each of said spacers and said member surfaces, and means for connecting said spacers to said equipment.

18. A device according to claim 17 wherein said pads are molded integrally with said spacers and said member.

19. A device according to claim 18 including means for limiting movement of said member relative to said pads in a direction away from and toward said support.

20. A device for mounting and vibrationally isolating vibrating equipment from a support, which equipment has a neutral axis extending substantially proximate its center of mass and about which said equipment tends to oscillate, comprising a casing adapted to be mounted on said equipment, a cross bar disposed in said casing and having opposed outer ends extending transversely of said neutral axis and outwardly from said casing for connection to said support, said cross bar including a central portion disposed inside said casing and having a wedge-shaped cross section with the opposite outer surfaces thereof diverging in a direction away from said support, and a resilient bushing having a wedge-shaped cross section disposed inside said casing and encircling said cross bar central portion.

21. A device according to claim 20 wherein said bushing includes an elongated slot located in parallel spaced relation to each of the opposite sides of said cross bar and extending the entire length of said bushing.

22. A device according to claim 21 wherein said bushing is molded integrally with said casing and said cross bar.

* * * * *